United States Patent [19]

Hibbs

[11] Patent Number: 4,747,933

[45] Date of Patent: May 31, 1988

[54] ISOMERIZATION UNIT WITH INTEGRATED FEED AND PRODUCT SEPARATION FACILITIES

[75] Inventor: Frederick M. Hibbs, West Wickham, England

[73] Assignee: UOP Inc., Des Plaines, Ill.

[21] Appl. No.: 30,806

[22] Filed: Mar. 27, 1987

[51] Int. Cl.[4] ..... C10G 51/06

[52] U.S. Cl. ..... 208/79; 585/737

[58] Field of Search ..... 208/79; 585/737

[56] References Cited

U.S. PATENT DOCUMENTS

| | | | |
|---|---|---|---|
| 2,946,736 | 7/1960 | Muffat et al. | 208/65 |
| 3,018,244 | 1/1962 | Stanford et al. | 208/79 |
| 3,761,392 | 9/1973 | Pollock | 208/93 |
| 3,776,837 | 12/1973 | Dautzenberg et al. | 208/79 |
| 3,933,619 | 1/1976 | Kozlowski | 208/79 |
| 4,162,212 | 7/1979 | Miller | 208/79 |
| 4,181,599 | 1/1980 | Miller et al. | 208/79 |
| 4,457,832 | 7/1984 | Robinson | 208/66 |

OTHER PUBLICATIONS

The Handbook of Petroleum Refining Processes, pp. 5-49 through 5-51, 1st edition, edited by Robert A. Meyers, published by McGraw Hill Book Company.

*Primary Examiner*—Curtis R. Davis

*Attorney, Agent, or Firm*—Thomas K. McBride; John F. Spears, Jr.; John G. Tolomei

[57] ABSTRACT

A combination isomerization-reforming process provides additional liquid volume yields of gasoline without significant increase in utilities expense by recycling the isomerization zone effluent to an extended feed fractionation zone from which an isomerization product is also withdrawn. The feed fractionation zone receives a $C_5$-plus boiling range naphtha feed. The fractionation zone provides a relatively heavy bottoms stream for a reformer feed and a relatively lighter sidecut stream for feed to an isomerization zone. Effluent from the isomerization zone is recycled to the feed fractionation zone at a midfractionation entry point. A net overhead stream withdrawn from the feed fractionation zone and containing principally $C_6$ isoparaffins and lighter boiling hydrocarbons provides a relatively high octane blending component. The fractionation zone overhead stream may be combined with effluent from the reforming zone to obtain a gasoline product, at high liquid volume yield, having sufficient octane for unleaded motor fuel use.

16 Claims, 1 Drawing Sheet

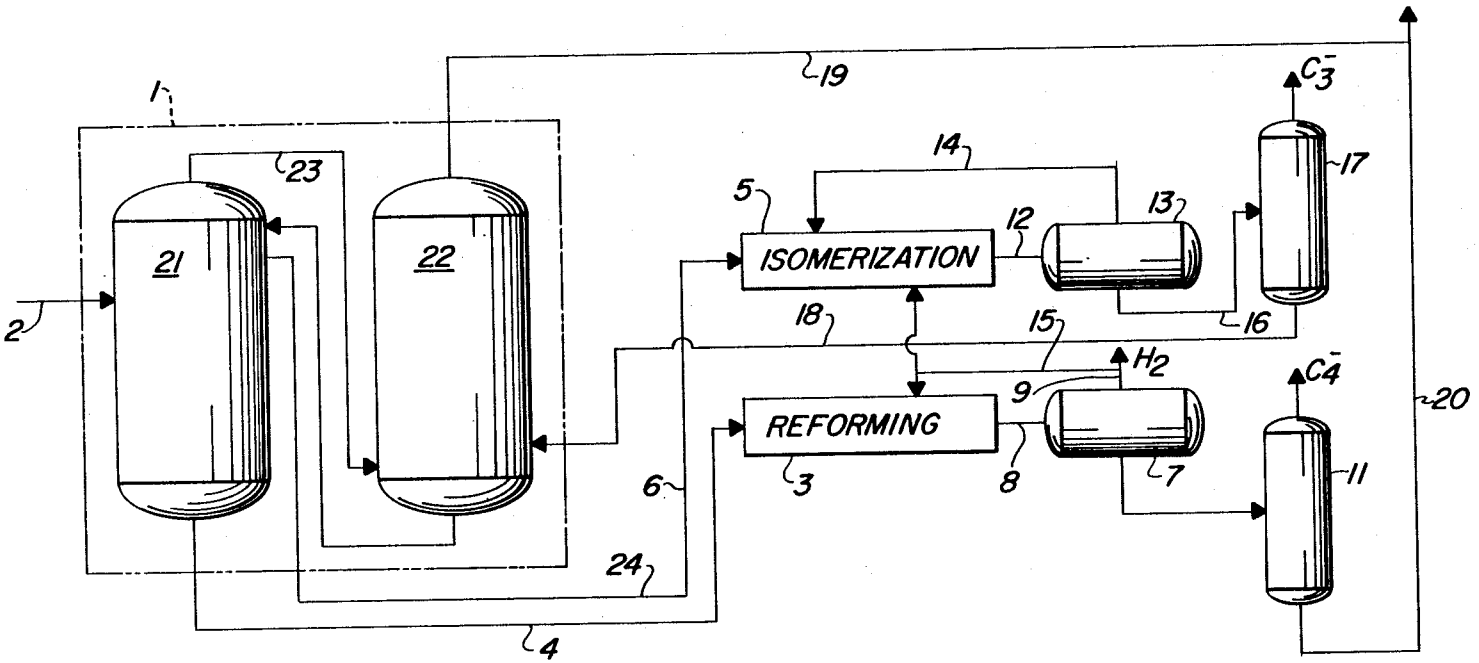
ISOMERIZATION
REFORMING
$C_3^-$
$C_4^-$
$H_2$
1
2
3
4
5
6
7
8
9
11
12
13
14
15
16
17
18
19
20
21
22
23
24

ISOMERIZATION UNIT WITH INTEGRATED FEED AND PRODUCT SEPARATION FACILITIES

BACKGROUND OF THE INVENTION

1. Field of the Invention

This invention relates generally to hydrocarbon conversion processes. More specifically, this invention relates to the catalytic isomerization of paraffinic hydrocarbons and the separation facilities for obtaining the feed fraction and recovering the product from the isomerization unit. In addition, this invention relates to combination processes for the isomerization and reforming of naphtha boiling range hydrocarbons wherein such processes are performed to produce naphtha boiling range products having sufficient octane number for use as unleaded motor fuel.

2. Description of the Prior Art

High octane gasoline is required for modern gasoline engines. Formerly it was common to accomplish octane number improvement by the use of various lead-containing additives. As lead is phased out of gasoline for environmental reasons, it has become increasingly necessary to rearrange the structure of the hydrocarbons used in gasoline blending in order achieve higher octane ratings. Catalytic reforming and catalytic isomerization are two widely used processes for this upgrading.

A gasoline blending pool normally includes $C_4$ and heavier hydrocarbons having boiling points of less than 205° C. at atmospheric pressure. This range of hydrocarbon includes $C_4$–$C_6$ paraffins and especially the $C_5$ normal paraffins which have relatively low octane numbers. The $C_4$–$C_6$ hydrocarbons have the greatest susceptibility to octane improvement by lead addition and were formerly upgraded in this manner. Octane improvement can also be obtained by rearranging the structure of the paraffinic hydrocarbons into branched-chained paraffins or aromatic compound by isomerization. The $C_6$ and heavier hydrocarbons can be upgraded into aromatics through catalytic reforming. $C_5$ hydrocarbons are not readily converted into aromatics, therefore, the common practice has been to isomerize these lighter hydrocarbons into the branch chain isoparaffins. Although the $C_6$ paraffins can be converted to aromatic hydrocarbons through the hydrocyclization, that conversion also causes a reduction in liquid volume yields. The reduction in liquid volume yields results from increased gas production and conversion to higher density species. Therefore, it is also common practice to charge $C_6$ paraffins to an isomerization unit to obtain $C_6$ isoparaffin hydrocarbons. Consequently, octane upgrading commonly uses isomerization to convert $C_6$ and lighter boiling hydrocarbons and reforming to convert $C_7$-plus and higher boiling hydrocarbons.

The combination processes using isomerization and reforming to convert naphtha range feedstocks are well known. U.S. Pat. No. 4,457,832 uses reforming and isomerization in combination to upgrade a naphtha feedstock by first reforming the feedstock, separating a $C_5$–$C_6$ paraffin fraction from the reformate product, isomerizing the $C_5$–$C_6$ fraction to upgrade the octane number of these components and recovering a $C_5$–$C_6$ isomerate liquid which may be blended with the reformate product. U.S. Pat. Nos. 4,181,599 and 3,761,392 show a combination isomerization-reforming process where a full range naphtha boiling feedstock enters a first distillation zone which splits the feedstock into a lighter fraction which enters an isomerization zone and a heavier fraction that is charged as feed to a reforming zone. In both the '392 and '599 patents, reformate from one or more reforming zones undergoes additional separation and conversion, the separation including possible aromatics recovery, which results in additional $C_5$–$C_6$ hydrocarbons being charged to the isomerization zone.

It is also known in the art that further octane enhancement can be obtained by recycling at least a portion of the normal paraffins in the effluent of the isomerization zone back through the isomerization zone to obtain additional conversion of paraffins to isoparaffins. Separation facilities and flow schemes for recycling $C_5$ paraffins, $C_6$ paraffins or both through an isomerization unit are shown and described at pages 5–49 through 5–51 of *The Handbook of Petroleum Refining Processes* edited by Robert A. Meyers, published by McGraw Hill Book Company (1986). Recycling is particularly effective due to the equilibrium nature of the pentane and hexane isomerization reactions.

Schemes for recycling the effluent from an isomerization zone include return of at least a portion of the isomerization effluent to the separation facilities for initially splitting a straight-run naphtha feed into light and heavy fractions for the isomerization and reforming zone, respectively. U.S. Pat. No. 3,018,244 shows such an arrangement where a pentane fraction is recycled and combined with the fresh feed entering a series of fractionation columns for removing light components from the feed and separating the feed into light and heavy fractions for the isomerization and reforming sections. U.S. Pat. No. 2,946,736 shows a process flow scheme for an isomerization-reforming combination where at least a portion of the isomerization zone effluent is combined with a hydrotreated naphtha feed and the reforming zone effluent which then enters a fractionation column for splitting the entering components into light and heavy fractions. The light fraction then undergoes further separation to remove isoparaffins and higher octane components from the normal paraffin hydrocarbons which are charged as feed to isomerization zone.

When the use of lead additives was readily permitted, $C_5$ and $C_6$ paraffinic hydrocarbons were the most susceptible to octane improvement by the addition of lead additives. Since these additives are relatively cheap, there was no economic incentive for enhancing the octane number of $C_5$ and $C_6$ paraffins through isomerization. As a result, a large number of reforming facilities are in existence that have no isomerization zone or capability for recycling normal $C_5$ and $C_6$ paraffins to upgrade the octane value of these components, but contain only the reformer and a splitter section for separating a naphtha boiling range feed into light and heavy components. Consequently, it is highly desirable to provide a method for upgrading the $C_5$ and $C_6$ normal paraffins using existing separation facilities to the greatest degree possible.

SUMMARY OF THE INVENTION

Although it is known that the recycle of unconverted normal paraffins to the isomerization zone will increase the octane number of the isomerization zone product or the total octane number of the combined isomerization and reforming zone products, the additional facilities and utilities required for the recycle make the octane improvement relatively expensive. Therefore, it is advantageous to gain the benefit of the higher octane without the drawback of increased facilities or utilities. The extra facilities often associated with adding additional recycle capability include separation columns, pumps, condensers, separators, and the piping associated therewith. When providing additional recycle capability, utilities are increased by the cost of the energy needed to run the extra facilities. Although both the facilities and utilities represent an added cost to operating the process and a reduction in the economic benefit from upgrading the octane through additional recycle, facilities generally represent a capital expense while utilities are an on-going expense. As a result, a reduction in utilities will usually have a greater effect in increasing the cost benefit obtained by upgrading the octane number of the isomerization zone product.

In addition, the octane number in a blended pool of isomerized and reformed hydrocarbons is the product of the octane number produced in both the isomerization and reforming operations. As a result, a target octane number for a gasoline blend can be achieved by raising the octane number of the isomerization product, reforming product, or both. However, a higher octane number for the reformer product demands greater severity operation which increases gas production and the conversion to higher density hydrocarbon species. Both of these results contribute to a reduction in liquid volume yields. Hence, it is desirable to obtain the additional octane from an upgrading of the isomerization zone product.

It has been surprisingly discovered that the octane number of products from an isomerization zone can be upgraded with little or no increase in utilities by returning the effluent from the isomerization zone to, and withdrawing an isomerization product stream from, the same separation facilities for splitting the charge stock and supplying the isomerization zone feed fraction.

Accordingly, it is an object of this invention to reduce the separation facilities needed to upgrade the octane number of products obtained from a catalytic isomerization zone.

It is a further object of this invention to reduce the cost of utilities for recovering and recycling the isoparaffin and paraffin fractions from a catalytic isomerization zone.

It is another object of this invention to provide a combination isomerization and reforming zone that utilizes common separation zones in a highly efficient manner.

Yet another object of this invention is to maximize liquid volume yield of gasoline product from a combination isomerization-reforming process.

A yet further object of this invention is to combine catalytic isomerization and reforming zones in a process scheme that uses a common separation facility to split a naphtha boiling range feed into reforming and isomerization zone input fractions, with the same separation facility recovering the isomerization zone product.

In its most basic form, this invention is a method of recovering an upgraded isomerate product stream from a fractionation zone that separates a naphtha boiling range charge stock into a heavy hydrocarbon stream, normally used as feed to a reforming zone, and a light hydrocarbon feed stream for an isomerization zone and receives the effluent from the isomerization zone as a recycle stream.

A general embodiment of this invention may be described as a process for upgrading $C_5$ and $C_6$ components of a $C_5$ and higher boiling feed stream into higher octane components. The feed stream first enters a fractionation zone and is separated into higher and lower boiling components. A relatively heavy stream comprising $C_7$ and heavier hydrocarbons is withdrawn from the fractionation zone. An intermediate stream rich in $C_6$ and lighter hydrocarbons is withdrawn from the fractionation zone and contacted in an isomerization zone with an isomerization catalyst at isomerization conditions to convert normal paraffins to isoparaffins. At least a portion of the effluent from the isomerization zone is recycled to the fractionation zone. A relatively light hydrocarbon stream containing mainly $C_6$ isoparaffins and higher boiling hydrocarbons is withdrawn from the fractionation zone and recovered as an isomerization product stream.

In a more specific embodiment, this invention is a process for upgrading a $C_5$ naphtha boiling range hydrocarbon stream into higher octane components. According to this embodiment, the naphtha feed stream passes into a fractionation zone from which a bottoms stream comprising $C_7$-plus hydrocarbons is withdrawn. The bottoms stream enters a reforming zone where it is contacted with reforming catalyst at reforming conditions to produce a relatively high octane reformate product stream. A sidecut stream comprising normal hexane and lighter hydrocarbons is withdrawn from the fractionation zone and passed to an isomerization zone where it is contacted with isomerization catalyst at isomerization conditions to produce an isomerization zone effluent rich in $C_6$ isoparaffins and lower boiling hydrocarbons. At least a portion of the isomerization zone effluent is recycled to the fractionation zone. An overhead stream comprising main $C_6$ isoparaffins and lighter hydrocarbons is withdrawn from the fractionation zone and recovered as a relatively high octane isomerate product stream. The reformate and isomerate products are combined to produce a high octane gasoline blend.

BRIEF DESCRIPTION OF THE DRAWING

The drawing represents a preferred embodiment of this invention wherein a $C_5+$ naphtha boiling range feed enters a fractionation zone 1 through a line 2 and is there split into a reforming feed fraction, passing to a reforming zone 3 through a line 4, and two lighter cuts, one of which is part of an isomerization zone feed fraction passing to an isomerization zone 5 through a line 6. Effluent from the reforming zone passes to a separator drum 7 via line 8. An off gas stream having a high concentration of hydrogen is carried from drum 7 by line 9 and recycled in part by line 15 to the reforming zone. Line 10 routes accumulated liquid from drum 7 into stabilizer column 11. The effluent from isomerization zone 5 passes through line 12 into separator drum 13. An off gas rich in hydrogen is recovered from drum 13 and recycled to the isomerization zone by line 14. Line 15 supplies net hydrogen from drum 7 to isomerization zone 5. Accumulated liquid from drum 13 passes through line 16 into stabilizer column 17.. Stabilized liquid from column 17 enters separation zone 1 via connecting line 18. Isomerization zone product and feed components pass overhead from separation zone 1 into line 19 and are combined with reformate product, taken from the bottom of stabilizer 11 by line 20, to form a high octane gasoline blend.

DETAILED DESCRIPTION OF THE INVENTION

The objectives of this invention relate to octane improvement and increased liquid volume yields with a minimum of capital outlay and curtailment of utility expenses through the arrangement and interconnection of feed separation facilities with an isomerization zone. The objectives are achieved by utilizing the same separation facilities for splitting a naphtha boiling range feed, at least partially deisohexanizing an isomerization zone effluent, and recovering an isomerization zone product. In this manner, the octane number of the isomerization zone product can be increased with only a small increase in capital outlay for separation facilities and no significant increase in utilities expense. Therefore, feed separation facilities and the isomerization zone operation are of primary importance to the process.

The drawing of this invention shows a preferred embodiment of this invention wherein the isomerization process is integrated with a reforming process. However, the illustration and following description of the invention in the context of a combination isomerization and reforming process is not meant to limit the invention or exclude other embodiments which are the result of normal and expected modifications by those well skilled in the art. Further, the drawing has been simplified to eliminate many pieces of processing equipment which are well known in processes of this nature and include such items as pumps, compressors, overhead condensers, reboilers, control systems, etc. These items have been eliminated since they are not necessary to illustrate the invention.

Accordingly, an important element of this invention is an isomerization zone. The core of the operation of the isomerization zone is the passage of the feed stream through a reactor maintained at paraffin isomerization promoting conditions including the presence of an acidic isomerization catalyst. It is preferred that the paraffin feed stream is passed through one or more fixed beds of catalyst located within a single reaction zone. The conditions necessary for successful operation of the isomerization zone are dependent upon both the charge material and the specific catalyst employed within the reaction zone. The average reactant temperature may be as high as 430° C. (800° F.) but is preferably between 100° and 320° C. Specific embodiments of this invention are concerned with the isomerization of $C_5$ and $C_6$ normal paraffins. For these materials the inlet temperature to the isomerization reaction zone may range from 120 ° to about 315° C. with a particularly preferred operating range being from about 150 ° to 275° C. The isomerization reaction is exothermic. Depending upon the degree of conversion and the amount of benzene in the charge material, a temperature rise of 18 ° to 35° C. can normally be expected through the isomerization zone. Benzene has a large effect on the reaction outlet temperature because it is hydrogenated in the isomerization zone in a reaction that is more exothermic than the isomerization reaction of the normal paraffin. The presence of benzene in the charge of the isomerization zone is permitted to minimize fractionation expense.

The isomerization reaction zone may be maintained over a wide and theoretically unlimited range of pressures, however, a normally practiced range of operation pressures are between 345 kPag (50 psig) and 10,400 kPag (1500 psig). When operating in combination with a reforming zone, the isomerization zone is preferably operated at pressures that will enhance the utilization of common vessels in interconnecting piping. In such an arrangement, it is preferred to operate the isomerization reaction zone at a pressure below 3500 kPag gauge (500 psig) and more preferably, at about 1700 kPag (250 psig).

Hydrocarbons passing through the isomerization zone are normally in admixture with between 0.5 and about 10 moles of hydrogen per mole of hydrocarbon. The presence of hydrogen in this concentration ensures vapor phase conditions and suppresses coke deposition on the catalyst. The isomerization reactor can be operated at liquid hourly space velocities between 0.5 to 12.0 $hr.^{-1}$, however, space velocities between 1.0 and 6.0 $hr.^{-1}$ are preferred.

A number of satisfactory paraffin isomerization catalysts are known in the art. Preferably, the catalyst comprises a platinum group metal supported on a refractory inorganic oxide. That is, the use of a fixed bed of catalyst is preferred in the isomerization zone. The preferred physical shape of the catalyst is not limited and may consist of spheres, pellets, or extrudates. Suitable solid refractory oxides can be selected from a variety of materials and include silica, alumina, titanium dioxide, chromia, or mixtures of these oxides; various naturally occurring refractory oxides at differing degrees of purity such as bauxite, bentonite, clay, and mordenite; or diatomaceous earth such as kieselguhr. Of these materials, alumina and mordenite are preferred and synthetically prepared. Substantially anhydrous gamma-alumina with a high degree of purity is particularly preferred. The term platinum group metals refers to noble metals, excluding silver and gold, which are selected from the group consisting of platinum, palladium, germanium, ruthenium, rhodium, osmium, and iridium. These metals demonstrate differences in activity and selectivity such that platinum and palladium are normally preferred with the use of platinum as the platinum group metal being highly preferred. The preferred catalyst will contain less than 2 wt. % of the the platinum group component with the preferred concentration of this component of the catalyst being from about 0.1 to 0.5 wt. %. The platinum group component of the catalyst may exist within the final catalytic composite as an oxide or sulfide or halide, etc. or as an elemental metal. There are a variety of suitable ways of preparing the catalytic composite for the isomerization zone and incorporating the platinum group metal therein. A preferred method of preparing the catalyst impregnates the carrier material by contacting it with an aqueous solution of a water soluble decomposable compound of a platinum group metal. Impregnation may be carried out by dipping the carrier material in a solution of chloroplatinic acid, ammonium chloroplatinate, bromoplatinic acid, or platinum dichloride. Using platinum chloride compounds facilitates the incorporation of both the platinum component and at least a minor quantity of a halogen into the catalyst.

Particularly preferred isomerization catalyst compositions also include sulfur tolerant compositions comprising a Group VIII noble metal, hydrogen form crystalline aluminosilicate, and a refractory inorganic oxide having a surface area of at least 580 $m^2/g$. Such compositions may also contain, in addition to the previously described Group VIII noble metal, a catalytically effective amount of a promoter metal. Examples of such promoter metals include tin, lead, germanium, cobalt, nickel, iron, tungsten, chromium, molybdenum, bismuth, indium, gallium, cadmium, zinc, uranium, copper, silver, gold, tantalum, one or more of the rare earth metals and mixtures thereof. The crystalline aluminosilicate of the present invention is a hydrogen form silica-alumina having either a three-dimensional or channel-pore-structure crystal lattice framework. The three-dimensional aluminosilicates include both synthetic and naturally occurring silica aluminas, such as, the faujasites which include X-type, Y-type, ultrastable-Y and the like. L-type, omega-type, and mordenite are examples of the channel-pore-structure crystalline aluminosilicates. The aluminosilicate material that is preferred in the catalytic composition of this invention is mordenite. The hydrogen form aluminosilicate is incorporated with a refractory inorganic oxide and formed into a catalyst composite. The formed catalyst composite may be prepared by any known method in the art including the well-known oil drop and extrusion methods. The hydrogen form aluminosilicate may be present in an amount within the range of 50 to about 99.5 wt. %, preferably within the range of 75 to about 95 wt. %, and the refractory inorganic oxide may be present in an amount within the range of from 0.5 to about 50%.

Many isomerization catalysts also contain a halogen component. The halogen component, termed in the art a combined halogen, may be present in an amount from about 0.05 to about 6.5 wt. % based upon the dry support material. If the catalyst comprises a halogen component, it is preferably present in an amount greater than about 0.5 wt. %. The halogen component would normally be selected from fluorine and chlorine with chlorine being particularly preferred. The halogen component may be composited with the carrier material during the impregnation of the carrier material with the platinum group component by the utilization of a mixture of chloroplatinic acid and hydrogen chloride. An alternate method uses an aluminum hydrosol to form an aluminum carrier material which also contains at least a portion of the halogen. Another method of adding the halogen is by contacting a calcined carrier material with an aqueous solution of an acid such as hydrogen chloride, hydrogen fluoride, or hydrogen bromide. Highly suitable isomerization catalysts may be produced by the teachings of U.S. Pat. Nos. 2,999,074 and 3,649,704. Additional information on the preparation and use of isomerization catalyst may be obtained by reference to U.S. Pat. Nos. 3,442,794, 4,238,319, and 4,489,216.

Another important element of this invention are the feed separation facilities and their interconnection with the isomerization zone. Although the novelty of this invention lies, at least in part, in the arrangement of the separation zone and the interconnection of that zone with the isomerization zone, the process of this invention does not require any unique or unusual equipment. Therefore, those skilled in the art of hydrocarbon or petroleum process design are capable of designing satisfactory equipment for performing the process of this invention after being made aware of the general nature of the equipment employed therein and the objects to be achieved thereby. The fractionation zone of this invention preferably employ tray-type columns having sieve-type trays, and an overhead condensing system and a reboiling system, both of conventional design. When used in connection with this invention, the term rich is intended to indicate a concentration of a specified compound or class of compounds which exceeds 50 mole percent in the specified stream.

Referring again to the drawing, fractionation zone 1 is shown receiving a full boiling range naphtha feed. Suitable feedstocks would primarily contain $C_5$-plus hydrocarbons up to an end boiling point of about 210° C. with an end boiling point of 185° C. being preferred. Minor amounts of other hydrocarbons boiling outside this range may also be present in the feed entering fractionation zone 1. The hydrocarbon species present in significant degree in the feed include paraffins, isoparaffins, naphthenic and aromatic compounds. Such feedstocks can be obtained from naphtha fractions that have undergone debutanization. Hydrotreatment of the feed, prior to entering the fractionation, may also be desirable where a reforming zone is used and both the isomerization zone catalyst and reforming zone catalysts are susceptible to sulfur deactivation.

The separation zone 1 of this invention has primarily two inputs, the feed and isomerization zone recycle; and three outputs, an isomerate product stream, an isomerization feed fraction and a heavy hydrocarbon stream. One or more fractionation columns can be included in the separation zone. It is expected that the sum of the trays in these columns will total 70 or more. The full range naphtha feed is introduced at or near the column midpoint at a location selected to provide a good split between the feed components. The fractionation splits the feed into a heavy hydrocarbon stream principally containing $C_7$ and higher boiling hydrocarbons and lighter hydrocarbon fractions boiling at and above the boiling point of normal hexane. The heavy stream is typically withdrawn from the fractionation zone as a bottom stream and may contain small amounts of aliphatic and aroma $C_6$ hydrocarbons which will not detrack from the operation of the process.

The isomerization zone feed fraction is a relatively lighter boiling fraction that is removed as a sidecut from the fractionation zone. Sidecut location is selected to maximize normal hexane concentration while limiting withdrawal of $C_6$ isoparaffins and lower boiling components. The sidecut may be withdrawn as a liquid or vapor phase. Typically, this criteria results in a sidecut location above the feed inlet point.

At least a portion of the effluent from the isomerization zone returns to the fractionation zone as a recycle stream. The recycle stream is rich in $C_6$ isoparaffins and higher boiling hydrocarbon species. It is, therefore, introduced at a column location above the sidecut withdrawal point so that the isoparaffins will go overhead and the $C_6$ normals will drop. Those skilled in the art will be able to optimize the recycle entry point to minimize $C_6$ normals and maximize $C_6$ isoparaffins in the isomerate.

The upper end of the fractionation zone is designed to drop normal $C_6$'s from the isomerization zone product stream. Normally, the isomerization zone product stream is withdrawn from the column as an overhead stream. The components of the isomerization product stream includ $C_6$ isoparaffins and lighter boiling materials from both the feed stream and isomerization recycle stream.

The feed sidecut, after passing through the isomerization zone, will enter separation facilities to remove off gases and stabilize the effluent by depropanization. A typical separation scheme is shown in the drawing where effluent from the isomerization zone 5 enters drum 13, after appropriate cooling and condensing to collect most of the $C_4$-plus hydrocarbons. Vapors collected in drum 13 comprise a hydrogen-rich off gas stream which is recycled to the isomerization zone through line 14. Liquid condensate from drum 13 enters stabilizer column 17 and light ends such as ethane and propane are removed overhead while a bottoms stream comprising the isomerization zone product is withdrawn. A variation of this flow scheme would allow at least a partial recovery of the net isomerization zone product from line 18 for other uses such as direct blending in the gasoline pool without recycle to fractionation zone 1.

Such a variation might be practiced where an existing isomerization unit has excess capacity that would allow some recycle but not the entire increase in throughput that would result from recycle of the entire effluent flow. However, in order to realize the benefits of this invention, a substantial amount of the isomerization effluent, on the order of about 10 wt. %, must be recycled. The isomerization zone product returned to fractionation zone 1 contains substantial amounts of normal $C_6$ paraffins. Recycle of normal hexane as part of the feed to the isomerization zone reduces the normal paraffins concentration in the isomerization zone. As a result, the overhead product stream from the fractionation zone has a very low concentration of $C_6$ normal paraffins and is rich in $C_5$ and $C_6$ isoparaffins. The relatively higher concentration of isoparaffins in overhead stream 19 increases the octane number over that obtained by the isomerization zone alone.

It is believed that recycle of the isomerization zone effluent, which is a relatively hot stream, provides additional heat input to the fractionation zone. This additional heat input can thereby reduce the reboiler duty and contributes to the conservation of utilities which allows the additional split between $C_6$ isoparaffins and normal hexane to be obtained at little or no additional utility expense. In fact, in some instance, the utility requirements for simply splitting a naphtha feed stream directly into light and heavy components will be slightly higher than the utilities of the fractionation column with the sidecut and recycle stream.

In the integrated process embodiment of this invention, the heavy hydrocarbon stream from the bottom of the fractionation zone passes to a reforming zone. As the embodiment depicted by the drawing shows, hydrocarbons entering the reforming zone 3 are combined with recycled hydrogen passing into the reforming zone via conduit 15. The reforming zone includes one or more reactors, feed exchangers, and heaters for raising the temperature of the reactants as they pass to the reactors. Reaction products from the reforming zone typically include a significant amount of hydrogen as well as other light ends material such as butane, propane, and ethanes which are conveyed by line 8 to separator drum 7. After removal of hydrogen rich gas, condensate from drum 7 is passed in the stripping column 11 where light ends such as ethane, propane, and butane are removed overhead while a bottoms stream comprising naphthene boiling range hydrocarbons are collected as a product. As previously stated, the reformate and isomerate products may be combined to provide an octane enriched gasoline blend.

The reforming zone which may be used in this invention is operated in the vapor phase with a catalyst bed temperature in the range of 400°–570° C. (750°–1050° F.). Normally it is not desired that the catalyst temperature exceed 550° C. (1020° F). Other reforming conditions include pressures generally in the range of about 140–6900 kPag gauge (20 psi to 1000 psig), with pressures above about 690 kPag gauge (100 psi) being preferred. In an isomerization reforming combination process, a liquid hourly space velocity of about 0.2:10 and a hydrogen to hydrocarbon mole ratio in an approximate range of 0.5–1.0:10.0–1.0 are typical conditions, with a liquid hourly space velocity in the range of 1.0–8.0 being preferred. The reforming zone will typically contain multiple catalyst beds. Practice of this invention will require a lower octane number from the reforming zone product such that the inlet temperature to the catalyst bed can normally be maintained below 515° C. (960° F.).

These beds consist of a reforming catalyst which typically contain one or more Group VIII noble metals (platinum, iridium, rhodium, and palladium) and a halogen such as chlorine and/or fluorine. These components of a catalyst are supported on a porous refractory carrier material such as alumina. The reforming catalyst may also contain one or more additional metallic catalytic components such as rhenium, germanium, or tin. Further details on catalyst suitable for catalytic reforming may be obtained by reference to U.S. Pat. Nos. 3,740,328, 3,745,112, 3,948,804, and 4,367,137. The use of fixed bed reactors is preferred. The catalyst may, therefore, be present in the form of an extrudate or pellet. In contrast, the preferred physical form of the catalyst for use in a moving bed reaction and regeneration train is in the form of hard spherical particles having a diameter of from about 1/64 to about 5/32 of an inch (0.0397 to 0.397 cm). Reforming catalyst is available commercially from a number of suppliers.

The configuration of the reforming reaction zone and the composition of the catalyst employed within this reaction zone are not basic elements of the invention or limiting characteristics of the invention. As mentioned above, fixed bed reforming reactors operating at a pressure equal to the isomerization zone reactor are preferred. Nevertheless, in order to provide a complete background to the subject invention, it is felt useful to also describe an alternative reactor system for use in the reforming zone. This system comprises a moving bed radial flow multi-stage reactor such as is described in U.S. Pat. Nos. 3,652,231, 3,692,496, 3,706,536, 3,785,963, 3,825,116, 3,839,196, 3,839,197, 3,854,887, 3,856,662, 3,918,930, 3,981,824, 4,094,814, 4,110,081, and 4,403,909. These patents also describe catalyst regeneration systems and various aspects of moving catalyst bed operations and equipment. This reactor system has been widely employed commercially for the reforming of naphtha.

In moving bed systems, small quantities of catalyst are periodically removed from the reactors and passed into a regeneration zone. A general overview of regeneration procedures and operating conditions is presented in the previously cited U.S. Pat. Nos. 3,652,231, 3,981,824, 4,094,814, and 4,094,817. The catalyst regeneration procedure includes a carbon burnoff step, and will normally also comprise subsequent drying and halogenation steps.

Although there is no limitation in the physical design of the fractionation zone other than those necessary to achieve composition of the desired fractionation streams, the drawing depicts the fractionation zone as consisting of two columns. It is normally expected that the fractionation zone will consist of either one large column or two smaller columns as shown in the drawing. The two smaller columns as shown are likely to used when this invention is applied to an existing reforming operation that has separation facilities for splitting a naphtha feed. With such installations, an isomerization zone can be added, the splitter column can be used as a first column from which the reforming and isomerization feeds are withdrawn, and a second column can be added to provide the overhead and receive the recycle stream. In such installations, the additional column can be added and communicated with the existing column by the addition of recirculation lines and an associated pump. This arrangement is shown in the drawing where column 21 is taken as the existing column. The overhead from column 21 is routed into the bottom of a new column 22 by carry over conduit 23. An underflow conduit 24 communicates the bottom of new column 22 with the top of existing column 22. The two-column arrangement is further modified to include the isomerization feed, sidecut, and recycle streams. Locations for the sidecut and recycle will be selected in the manner hereinbefore described. As demonstrated in the drawing, the recycle conduit 18 will usually be an input to the lower portion of the new column 22 and the feed sidecut will typically be taken near the overhead of existing column 21. The isoparaffin product is normally taken as an overhead from new column 22. Condensing facilities associated with the upper end of existing column 21 can be fitted and modified to serve the reflux requirements at the upper end of column 22. Similarly, aside from the addition of a pump for underflow conduit 22 and control systems associated therewith, existing reboilers, pumps, and other equipment already in existence for operation of existing column 21, will normally be suitable for the operation of the combined columns. Therefore, the addition of the extra column 22 can be achieved with only a minor investment in new equipment.

Whether the additional separation capacity for obtaining the added fractions are obtained with a new separation zone, or a modified separation zone as just described, the additional streams are obtained without a significant increase in overall utilities. The advantage of obtaining the additional fractional separation, along with the higher octane obtained thereby, are demonstrated by the following examples which are based upon engineering calculations and the study of operating commercial reforming and isomerization process units. These examples consider two cases. Case 1 is for the isomerization-reforming combination as shown in the drawing. Case 2 is for an isomerization-reforming zone combination in which a feedstock is split into feed fractions for the isomerization and reforming zone and each of these feed fractions are processed once through the respective zones and combined into a net product.

The feed stream for both examples has a composition given in Table 1 and comprises $C_5$ to 200° C. boiling point hydrocarbons derived from crude oil and which have been hydrotreated to remove sulfur and nitrogen compounds. The feed stream is charged to a first fractionation column in each example at flow rate of 24,000 barrels per day.

TABLE 1

| | |
|---|---|
| normal butane | 7.5 |
| $C_5$ isoparaffins | 126.9 |
| normal pentane | 189.1 |
| $C_5$ naphthenes | 17.3 |
| $C_6$ isoparaffins | 213.8 |
| normal hexane | 200.3 |
| benzene | 25.0 |
| $C_6$ naphthenes | 205.0 |

TABLE 1-continued

| | |
|---|---|
| $C_7$ isoparaffins | 215.0 |
| normal heptane | 250.0 |
| $C_7$ naphthenes | 100.0 |
| toluene | 50.0 |
| $C_8$ and heavier | 900.0 |

EXAMPLE I

In accordance with the inventiion, the feed enters a fractionation column having 70 trays. The column is operated with a reboiler duty of 41.5 MM BTU/hr. and a condenser duty of 27 MM BTU/hr.

A reformer feed having the relative composition given in Table 2 is withdrawn from the bottom of the column and charged to the reforming zone at a rate of approximately 16,800 barrels per stream per day. Reforming operations using platinum and rhenium metals on an alumina support as a ctalyst at average pressure and temperature conditions of 250 psi and 515° C. (960° F.), a liquid hourly space velocity of 1.2 and a hydrogen to hydrocarbon ratio of 6.5 produce a reforming product consisting of 1.7 wt. % hydrogen, 17.6 light gases, 20.5% mixed butanes and pentanes, and 60.2 $C_6$ and heavier hydrocarbons. The $C_4$ and heavier hydrocarbons are recovered at a rate of 10,400 barrels per day and form a reformate product stream for gasoline blending having a research octane number of 99.0.

TABLE 2

| | reformer feed fraction | sidecut to isomerization | stabilized isomerization recycle | fractionation overhead |
|---|---|---|---|---|
| butanes | — | 1.5 | 43.7 | 49.7 |
| $C_5$ isoparaffins | — | 59.7 | 148.7 | 215.9 |
| normal pentane | — | 115.4 | 44.4 | 118.1 |
| $C_5$ naphthenes | — | 19.5 | 13.7 | 11.5 |
| $C_6$ isoparaffins | 12.6 | 714.7 | 950.3 | 436.5 |
| normal hexane | 40.0 | 271.9 | 119.8 | 8.2 |
| benzene | 4.9 | 20.1 | 4.9 | — |
| $C_6$ naphthenes | 91.5 | 172.3 | 160.2 | 1.4 |
| $C_7$ isoparaffins | 194.7 | 27.0 | 6.7 | — |
| normal heptane | 245.9 | 4.1 | — | — |
| $C_7$ naphthenes | 99.5 | — | — | — |
| toluene | 50.0 | — | — | — |
| $C_8$ and heavier | 898.3 | 1.7 | — | — |

Another sidecut stream comprising the feed fraction to the recylce isomerization zone is withdrawn from the column at a rate of 12,800 barrels per day and charged to an isomerization zone. The relative composition of the sidecut stream is given in Table 2. Hydrocarbons in the isomerization zone are contacted with a platinum alumina catalyst containing 5.0 wt. % chlorine at an average temperature of 240° and a liquid hourly space velocity of 1.0. Processing conditions within the isomerization zone also include a hydrogen to hydrogen ratio of approximately 2.0 and a pressure of 450 psig. Processing the sidecut through the isomerization zone yields a product having, after stabilization by separation of $C_3$ and ligher components, the relative composition given in Table 2 at a flow rate of 12,800 barrels per day. The isomerization product is returned to the fractionation column as the recycle stream.

A mixture of lighter feed components and isomerization products are withdrawn overhead from the fractionation column and have a relative composition given in Table 2. The overhead stream which has been upgraded by the isomerization effluent has a research octane number of 86.3. When the overhead is combined with the reformate product, it yields 17,540 barrels per day of gasoline having a research octane number of 93.9 and a motor octane of 87.0.

EXAMPLE II

As a means of demonstrating the benefit of recycling the isomerization zone product through the fractionation zone in the manner of this invention, Example II was calculated to show the result when the feed stream is simply split and each feed fraction passed once through its respective conversion process.

Accordingly, the feed described in Table 1 is passed at the same rate as Example I to a splitter column having 36 trays. The splitter column has a reboiler duty of 41 MM BTU/hr. and a condenser duty of 31 MM BTU/hr. The splitter provides a bottoms stream of relatively heavy hydrocarbons and an overhead stream of relatively light hydrocarbons, each stream having the relative composition given in Table 3.

TABLE 3

| | reformer feed fraction | isomerization feed fraction | stabilized isomerization product |
|---|---|---|---|
| butanes | — | 7.5 | 17.3 |
| $C_5$ isoparaffins | — | 126.9 | 249.2 |
| normal pentane | — | 189.1 | 74.4 |
| $C_5$ naphthenes | — | 17.3 | 12.1 |
| $C_6$ isoparaffins | 8.82 | 205.1 | 377.6 |
| normal hexane | 32.0 | 168.4 | 47.6 |
| benzene | 4.0 | 21.0 | 0.0 |
| $C_6$ naphthenes | 86.5 | 118.5 | 72.0 |
| $C_7$ isoparaffins | 209.3 | 5.9 | — |
| normal heptane | 249.8 | — | — |
| $C_7$ naphthenes | 100.0 | — | — |
| toluene | 50.0 | — | — |
| $C_8$ and heavier | 899.9 | — | — |

The heavy hydrocarbon fraction is charged to the reformer at a rate of 16,900 barrels per day. Operations in the reforming zone are conducted in the same manner as carried out for Example I, except the conditions have been changed to provide a higher severity operation. Conversion in the reforming zone produces a product consisting of 1.9 wt. % hydrogen, 20.7 wt. % light gases, 23.5 wt. % mixed butanes and pentanes, and 53.9 wt. % $C_6$ and heavier hydrocarbons. In this case, $C_4$ and heavier hydrocarbons are recovered at a rate of 9330 barrels per day and form a reformate product stream for a gasoline blending pool having a research octane number of 102.

The overhead stream enters an isomerization zone at a rate of 7080 barrels per day. Except for the lower throughput, the isomerization zone is operated in substantially the same manner as the isomerization zone of Example 1. Processing of the overhead stream through the isomerization zone and subsequent stabilization by separation of $C_3$ and lighter hydrocarbons yields an isomerization zone effluent at a rate of 7120 barrels per day with the effluent having the composition given in Table 3 and an octane number of 83.1. Combining the stabilized reformate and isomerization effluent streams, and adding a butane stream to adjust this vapor pressure to approximately 9 psi produces 16,000 barrels per day of gasoline having a research octane number of 95.4 and a motor octane of 87.0.

Compared to Example II, the process of this invention as practiced in Example I produced a total of 940 more barrels per day of gasoline product at the same motor octane rating. In addition, the separator utilities for operating the multicut fractionation column were slightly lower for Example I when compared to the utilities required for the simple splitter used in the once through operation of Example 2. Thus, it has been surprisingly demonstrated that additional liquid volume yield can be obtained at the same motor octane number by the recycling of an isomerization effluent to a multiple cut fractionation zone. Of course, Example I does require a larger isomerization unit to accommodate the higher throughput resulting from the recycle stream. However, the operation of the larger isomerization zone requires only a small marginal increase in utilities. As a result, the gain in valuable product realized by this invention is obtained for essentially the cost of extending the feed splitter column and increasing the capacity of the isomerization zone.

What is claimed is:

1. A process for upgrading $C_5$ and $C_6$ components of a $C_5$ and higher boiling feed stream into higher octane components, said process comprising:
   (a) passing said feed stream into a fractionation zone and separating said feed stream into higher and lower boiling components;
   (b) withdrawing a relatively heavy stream comprising $C_7$-plus hydrocarbons from said fractionation zone;
   (c) withdrawing an intermediate stream, rich in normal hexane and lower boiling range hydrocarbons from said fractionation zone, and contacting said intermediate stream, in an isomerization zone, with an isomerization catalyst at isomerization conditions;
   (d) returning a recycle stream comprising at least a portion of the effluent stream from said isomerization zone to said fractionation zone; and
   (e) withdrawing a relatively light stream from said fractionation zone, said relatively light stream comprising $C_6$ isoparaffins and lower boiling hydrocarbons.

2. The process of claim 1 wherein said feed stream inlet, intermediate stream outlet, and recycle stream inlet have progressively higher locations on said fractionation zone.

3. The process of claim 1 wherein said relatively light stream, intermediate stream, and relatively heavy stream are the overhead, sidecut, and bottoms streams, respectively of the fractionation zone.

4. The process of claim 1 wherein said feedstream comprises a $C_5$-plus naphtha boiling range hydrocarbon stream having an end boiling point of 205° C.

5. The process of claim 1 wherein the isomerization zone effluent is stabilized by removal of $C_3$-minus hydrocarbons.

6. The process of claim 1 wherein said fractionation zone includes a first fractionation column from which said intermediate stream orignates and a second fractionation column that receives said recycle stream.

7. The process of claim 4 wherein said relatively heavy stream contacts a reforming catalyst at reforming conditions in a reforming zone.

8. The process of claim 7 wherein the effluent from said reforming zone is combined with said relatively light stream to form a gasoline product stream.

9. A process for upgrading a $C_5$ naphtha boiling range hydrocarbon feedstream, said process comprising:
   (a) passing said feedstream into a fractionation zone;

(b) withdrawing a bottoms stream comprising $C_7$-plus hydrocarbons from said fractionation zone and passing said bottoms stream to a reforming zone;

(c) contacting said bottoms stream, in a reforming zone, with a reforming catalyst at reforming conditions to produce a reforming product stream;

(d) withdrawing a sidecut stream comprising normal hexane and lower boiling hydrocarbons from said fractionation zone and passing said sidecut to an isomerization zone;

(e) contacting said sidecut with an isomerization catalyst at isomerization conditions in said isomerization zone to produce an isomerization zone effluent stream rich in $C_6$ and lower boiling hydrocarbons;

(f) passing at least a portion of said isomerization effluent stream to the fractionation zone as a recycle stream; and (g) withdrawing an overhead stream comprising $C_6$ isoparaffins and lower boiling hydrocarbons from said fractionation zone.

10. The process of claim 9 wherein the fractionation zone comprises trayed columns and the feed entry point, sidecut withdrawal point, and recycle entry point are at progressively higher tray locations.

11. The process of claim 10 wherein at least a portion of said overhead stream and said reformate product stream are combined to form a gasoline product stream.

12. The process of claim 11 wherein said sidecut stream consists essentially of $C_5$ and $C_6$ hydrocarbons.

13. The process of claim 12 wherein said isomerization zone effluent is charged to a stabilization zone for the removal of $C_3$ and lighter hydrocarbons before entering the fractionation column.

14. The process of claim 13 wherein said fractionation zone comprises at least two fractionation columns.

15. The process of claim 14 wherein said recycle stream enters a first column in said fractionation zone and said sidecut stream emanates from a second fractionation column in said fractionation zone.

16. The process of claim 9 wherein said fractionation zone is operated at a temperature and pressure to provide a cut point between the recycle stream and the sidecut stream at the boiling point of methyl pentane.

* * * * *